United States Patent [19]

Blytas

[11] 4,102,388

[45] Jul. 25, 1978

[54] HEAT RECOVERY PROCESS

[75] Inventor: George C. Blytas, Houston, Tex.

[73] Assignee: Shell Oil Company, Houston, Tex.

[21] Appl. No.: 836,470

[22] Filed: Sep. 26, 1977

Related U.S. Application Data

[63] Continuation of Ser. No. 725,760, Sep. 23, 1976, abandoned.

[51] Int. Cl.[2] ..... F25B 13/00; F25B 15/00

[52] U.S. Cl. ..... 165/1; 62/101; 62/112

[58] Field of Search ..... 165/1; 62/476, 101, 62/112, 335, 148

[56] References Cited

U.S. PATENT DOCUMENTS

| | | | |
|---|---|---|---|
| 2,464,072 | 3/1949 | Cornelius | 62/101 |
| 3,483,710 | 12/1969 | Bearint | 62/101 |
| 3,585,810 | 6/1971 | Sander | 62/148 |
| 3,609,086 | 9/1971 | Modahl | 62/112 |

*Primary Examiner*—Lloyd L. King
*Attorney, Agent, or Firm*—Albert J. Adamcik

[57] ABSTRACT

Heat energy, preferably from a low grade energy source, is concentrated and transferred to another medium by a multi-zone steam absorption procedure.

32 Claims, 1 Drawing Figure

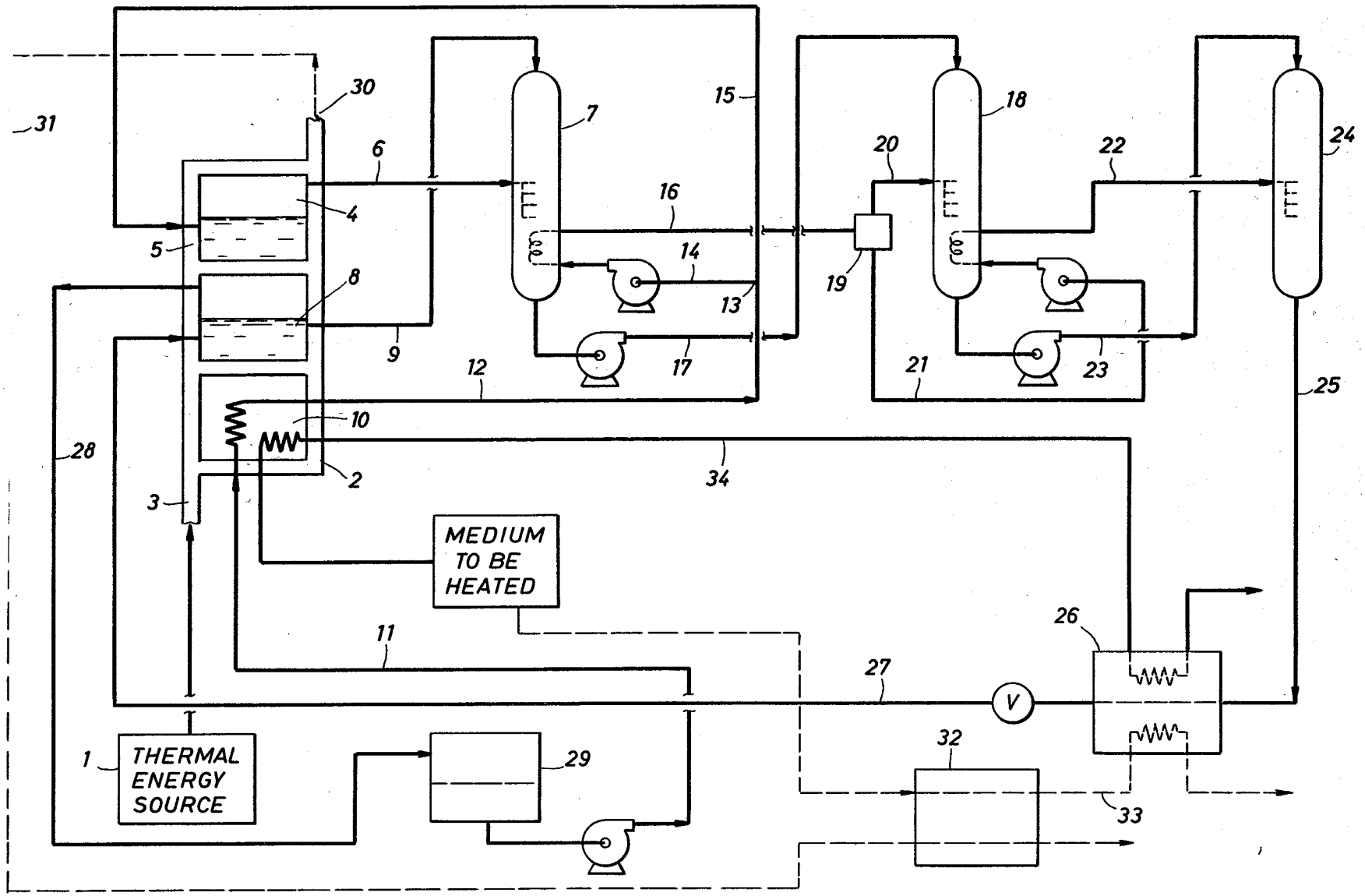
MEDIUM TO BE HEATED
THERMAL ENERGY SOURCE
V

HEAT RECOVERY PROCESS

This is a continuation of application Ser. No. 725,760, filed Sept. 23, 1976, now abandoned.

BACKGROUND OF THE INVENTION

Spiraling energy costs have renewed interest recently in the recovery of energy from a variety of energy sources. In particular, the recovery of thermal energy from low temperature waste heat streams and low-to-moderate temperature natural heat sources has received much study. For example, work has been done recently on the recovery of thermal energy from brines in a geothermal power plant, and on the recovery of energy from the exhausts of gas turbines and internal combustion engines. The present invention is concerned with the utilization of thermal energy, i.e., heat, from various heat sources, particularly heat sources having a relatively low heat content. These so-called "low grade" heat sources are found, e.g., in many industrial and commercial installations, such as refineries, chemical plants, and processing plants, as well as in geothermal sources, etc., and generally, whatever the medium, will have a temperature of or will transfer temperatures on the order of 100° to 150° C or 175° C. The invention has application to higher temperature heat sources, of course, but the great advantage of the invention resides in the fact that low grade heat sources may be utilized.

SUMMARY OF THE INVENTION

Briefly, the invention comprises a process in which thermal energy derived from a heat source, preferably a low grade heat source, is concentrated and transferred to another medium. If the heat source is steam, it may be used directly, exchanged indirectly with liquid water to make stream, or exchanged or combined with low grade steam to increase the heat content of the low grade steam. If the heat source is other than steam, it may be heat exchanged with liquid water to produce steam. In any event, even if "low grade", the heat source must be steam or be suitable for converting liquid water into steam.

Accordingly, the invention comprises a process for transferring thermal energy comprising contacting steam and a water absorbent solution in a first contact zone under conditions to absorb water, dilute the solution, and raise the temperature of the solution, the solution being in indirect heat exchange with an aqueous stream and raising the temperature of the aqueous stream, and converting the aqueous stream into steam and water, passing diluted solution from the first contact zone to a second contact zone, passing the aqueous stream from the first contact zone to a condensation and separation zone wherein the aqueous stream is separated into steam and liquid water, passing steam from the condensation and separation zone to a second contact zone wherein the steam is contacted with diluted solution from the first contact zone, under conditions to absorb water and dilute further the solution, and raise further the temperature of the solution, passing liquid water from the condensation and separation zone in indirect heat exchange with the further-diluted solution in said second contact zone, and converting the bulk of the liquid water into high temperature steam, passing further-diluted solution from the second contact zone to a third contact zone, and contacting further-diluted solution in the third contact zone with the high temperature steam from the second contact zone under conditions to absorb water and dilute the further-diluted solution, and form a high temperature, heavily-diluted solution, and transferring heat from the high temperature, heavily-diluted solution to a medium to be heated.

Preferably, the heavily-diluted solution is regenerated by evaporating the heavily-diluted solution, and then returning the concentrated solution to the first contact zone. The initial heat source is a preferred source of heat for this evaporation, and the invention additionally provides a variety of novel energy saving features. Use of the invention makes possible the recovery of thermal energy at, for example, 100° C, etc., and the concentration of the energy to provide, for example, the heating of a desired medium to 250° C or higher.

This concentration is accomplished, as noted supra, by contacting steam, or steam produced by heat exchange with a heat source, with an absorbent solution for the steam. While a great variety of water absorbent solutions may be employed, solutions of electrolytes and mixtures of electrolytes are preferred. Thus, solutions of $LiBr/H_2O$, $CaBr_2/LiBr/H_2O$, etc. may be employed. Those skilled in the art may readily characterize suitable absorbent solutions by routine determination of their vapor pressure, solubility, and $H_2O$ absorption characteristics, allowing for such considerations as corrosion and decomposition characteristics.

The volume of absorbent employed, as well as the volume of steam used, is, of course, dependent on such factors as the size of the heat supply, etc. Those skilled in the art, given the parameters set forth herein, may adjust the quantities of steam and absorbent to operate the process of the invention with a thermal efficiency approaching 0.3, or greater, excluding minimal pumping, etc. considerations.

In general, the ratio of steam sorbed/sorbing solution determines the magnitude of net heat available at the higher temperature; the higher this ratio, the greater is the upgrading potential of the system. This is due to the fact that a large ratio indicates that the sensible heat capacity of the absorbent is relatively small. Hence, the heat energy used in raising the temperature of the system itself is a small portion of the total heat effect, which is the heat of absorption of steam in the aqueous solution.

As indicated, the contact zones will be operated under conditions to absorb water and dilute the solutions, and raise the temperature of the solutions in the respective contact zones. In general, these conditions include appropriate pressures, temperatures, and concentrations of the absorbent solutions, as described more fully hereinafter. While the conditions of operation are widely variable, those skilled in the art will recognize that the interdependency of the contact zones requires that any variation of conditions in one contact zone must be compensated for by adjustment of conditions within the other contact zones. Additionally, those skilled in the art will recognize that the pressures, temperatures, and concentrations of absorbents in any given contact zone are also interdependent, so that, for example, a change in pressure in given contact zone will result in concommitant changes in concentration and temperature in that zone. Accordingly, each of the sets of conditions disclosed hereinafter are to be understood in conjunction with the other conditions set forth, since, for example, a given temperature change will call for corresponding pressure and concentration changes. In general, the conditions outlned herein satisfy equilibrium conditions.

The proportions of solute to water in the absorbent solutions employed may be varied greatly. For example, where electrolyte compositions are employed, the concentration of the electrolyte in the absorbent solution may range, in the initial contact zone, from 40 to 95 percent by weight, based on the total weight of the solvent and electrolyte, with concentrations of 60 to 90 percent by weight being preferred. As a practical matter, as those skilled in the art will recognize, the significant limitation on the ratio of solute to water is the pumpability of the combination.

Temperatures of the absorbent solution entering the first contact zone will be determined by the temperature of the heat source available. As indicated, the invention is well adapted to heat sources at temperatures of from 100° or 110° C to 250° C or higher. Thus, allowing for heat transfer losses, the absorbent solution will have approximately these temperatures. The aqueous stream in heat exchange with the solution will preferably have an initial or inlet temperature approximating that of the heat source, i.e.., from about 100° to about 250° C, preferably from about 110° to 200° C. The temperature of the steam supplied to the first contact zone will also be limited by the temperature of the heat source, e.g., 100° to 250° C or greater.

Temperatures of the solution in the second contact zone are dependent on those utilized in the first contact zone. The solution entering the second contact zone will be at the final temperature of the condensing solution of the first contact zone, minus any heat losses incurred between units, and the steam being supplied to the second contact zone will also have this temperature. For example, using the low grade heat source mentioned, temperatures of the solution entering the second contact zone may range from 130° to about 280° C, with temperatures preferably between about 160° and 220° C. As indicated, temperatures of the steam supplied to the second contact zone will approximate these temperatures. The liquid water which is vaporized by indirect heat exchange with the solution in the second contact zone may have an initial or inlet temperature of from about 130° to about 280° C, preferably from 160° to 220° C, and may have an outlet temperature of from about 150° to about 330° C, preferably from 160° to 220° C.

Temperatures of the solution entering in the third contact zone will approximate those of the solution leaving the second zone. In general, the temperatures may range from about 150° to about 330° C, with temperatures preferably employed from 160° to 320° C. Steam supplied to the third contact zone will have roughly the same temperature. The temperatures set forth herein are not to be taken as limiting, since proper design of units and good operation may permit higher temperature operation. This is true with regard particularly to the third contact zone, since higher temperatures may be achieved by suitable operation of the first and second contact zones. In general, temperatures achieved in the third contact zone may range from about 220° to about 350° C, preferably from about 240° to about 340° C.

Additional contact zones may be utilized, as desired. Often, however, the slight temperature increase to be obtained by additional contact zones will not justify the additional capital expense.

As those skilled in the art will appreciate, the sorption of steam in the first contact zone raises the temperature of the solution to an extent determined by the ratio, $$\frac{\text{steam sorbed}}{\text{mass of diluted solution}}.$$

The temperature rise in the first contact zone is such that the pressure of the resulting solution after steam sorption is still less than (but approaches) that of the steam pressure at heat source temperature. This condition must be obeyed in order to provide driving force for the sorption of steam in the first contacting zone. In the succeeding contact zones, the pressure of the steam supplied to the given zone must exceed the vapor pressure of the diluted solution leaving the zone. The difference in vapor pressure between the steam and the solution provides the driving force for condensation. By way of example, steam pressure in the first contact zone may normally range from about 15 to about 300 psia, and preferably from 30 to 200 psia. In the second contact zone, pressures may normally range from about 100 to about 350 psia, and preferably from 150 to 250 psia. In the third contact zone, pressures may range from about 200 to 600 psia, and preferably from 220 to about 400 psia. It is to be understood that these pressures refer to vapor pressures, and not the mechanical pressure used to pump the solutions or aqueous streams from unit to unit.

Pressures of steam generated by the heat source will depend on the temperature of the heat source, etc. In regenerating the diluted absorbent solution at a given waste heat temperature, the condenser operating pressure may be adjusted by those skilled in the art to achieve efficient evaporation. For example, if the heat source is used to regenerate the solution and is at, say 110° C, the condensing pressures may have to be maintained at less than 4 psia for efficient operation. With higher waste heat temperatures, higher condenser pressures may be adequate.

DETAILED DESCRIPTION OF THE INVENTION

In order to illustrate the invention, reference is made to the accompanying drawing. A thermal energy source 1, such as a hot waste stream, a geothermal source, or stack gas, enters combination boiler-generator-preheater 2 at 3. For the purpose of illustration, steam at 150° C will be employed as the thermal energy source, although those skilled in the art will readily recognize the utility of many other thermal energy sources. Again, although unit 2 is a preferred heat recovery configuration, other units may be used. For example, separate generator and evaporator units may be used. The advantage of unit 2 lies in its excellent heat recovery characteristics. A steam source may be used directly, if contaminants in the steam are not a problem. Moreover, it is within the scope of the invention that multiple different temperature sources of heat may be used so that, e.g., low temperature steam may be supplied to unit 7, while higher temperature steam from an available source might be supplied to units 18 or 24 (to be discussed more fully hereinafter) to supplement the heat supply.

Unit 2 comprises, as shown, a three-sectioned heat exchange apparatus. In section 4 a liquid water supply is converted to steam by indirect heat exchange with the steam passing through the passages 5 of unit 2. Steam at, e.g., 150° C and 65 psia, is passed through line 6 to contactor 7 at a rate of 144 lbs./hr. Concommitantly, the steam in passages 5 of unit 2 provides heat for evaporation of water from a regenerating absorbent solution of LiBr in section 8. Section 8 is operated, at 150° C and about 5 psia, so that an absorbent LiBr solution containing e.g., about 32.5 percent water by weight is provided in line 9 at 1000 lbs./hr. At the same time, the steam in passage 5 provides heat in section 10 for water in line 11. The water in line 11 may be from any water source, but preferably comes from a source to be discussed more fully hereinafter.

Steam from line 6 and the LiBr solution in line 9 are contacted in contactor 7. Because, as indicated previously, the vapor pressure of the diluted absorbent solution leaving unit 7 is less than the steam pressure in line 6, the steam will "condense" or be absorbed, diluting the absorbent solution and raising the temperature of the diluted solution. For the conditions mentioned, the temperature of the solution will be raised to a calculated temperature of about 198° C, and the solution is diluted to approximately 41 percent by weight. Concomitantly, water from line 11, having been heated to 150° C in section 10 of unit 2 is passed through line 12 and may be divided in portions at 13 into lines 14 and 15. The water in line 14 is pumped through contactor 7 in indirect heat exchange with the LiBr solution. The temperature of the water is raised to approximately that of the LiBr solution, i.e., about 198° C and converted partially into steam. The steam/water mixture leaves contactor 7 through line 16. Water in line 15, is circulated to section 4 of unit 2.

From contactor 7, diluted LiBr solution at, e.g., about 198° C is pumped through line 17 to a second contactor 18. Concomitantly, the steam/water mixture in line 16 is separated in condenser-separator 19 into steam and liquid water, and the steam is passed through line 20 to contactor 18. Steam from line 20, at a pressure of about 210 to 220 psig, is contacted with LiBr solution from line 17 in contactor 18, with resultant absorption of water, further dilution of the LiBr solution, and raising of the temperature of the solution to a calculated temperature of about 240° C. The concentration of the further diluted solution will be about 45 percent by weight LiBr. Simultaneously, liquid water from condenser-separator 19 is pumped through line 21, and through contactor 18 in indirect heat exchange with the LiBr solution. The temperature of the water is raised to approximately that of the LiBr solution, i.e., about 240° C, and the water leaves contactor 18 through line 22.

From contactor 18, the even further diluted LiBr solution is pumped through line 23 to a third contactor 24. Steam from line 22, at a pressure of about 250 psig, and the LiBr solution in line 23 are combined in contactor 24 with resultant absorption of water, further dilution of the LiBr solution, and raising of the temperature of the solution to a calculated temperature of about 250° C. The heated, dilute LiBr solution may be heat exchanged indirectly with a stream or medium to be heated (not shown) in contactor 24 or may be passed through line 25 to separate heat exchanger 26, which may be a direct or indirect heat exchanger, depending on the material to be heated. If the medium to be heated is a water stream, the heat exchange is preferably indirect, and the temperature of the water stream will be raised to approximately the temperature of the LiBr solution, i.e., about 250° C. By varying the temperatures, etc., in the contact zones, an additional contact zone or contact zones may be provided. The decision to use an additional contact zone or zones is dependent, inter alia, on the nature of the absorbent solution employed, as well as the size of the temperature increase to be gained when compared with the additional cost of the extra contact zone or zones.

The now cooled, heavily diluted LiBr solution from heat exchanger 26 is passed through line 27 back through an expansion valve to section 8 of unit 2 where it is concentrated for re-use.

The design shown in the drawing permits additional heat recovery. More particularly, water vapor from section 8 at 150° C and 5 psia, may be passed through line 28 to condenser 29, where the water vapor is condensed. The liquid water may then be pumped through line 11 thus providing water, as indicated previously, through section 10, line 12, etc., instead of depending on a separate source of water. Simultaneously, if steam is the thermal energy source provided by 1, the steam exiting unit 2 at 30 may be passed through line 31 (dotted line) to pre-heater 32 wherein the steam is exchanged with a medium to be heated. The steam or water exiting 32 may be exhausted to waste or used further, while the heated medium may be passed through line 33 (dotted line) to exchanger 26 or contactor 24 where it is heated, as discussed previously. Preferably, however, the medium to be heated may be heat exchanged or preheated initially with the heat source, for example, in a modified unit 2, so that the medium to be heated will already have the heat source temperature before it is passed through line 34 and heated, for example, in unit 26. Those skilled in the art will recognize that units 7, 18 and 24 may be constructed as one large unit rather than as separate structures, thus realizing additional heat and capital economies.

The following tables illustrate calculated temperature, concentration, and pressure values for various absorbents and heat sources. Volumes and flow rates may be calculated by those skilled in the art.

TABLE I

Heat source temperature of 150° C; absorbent is LiBr solution containing 32.5 wt. percent water.

| | Absorbent Concentration (Weight Percent Of Water) | Temperature Rise (At) In Contact Zones | Pressures In Contact Zones | Condenser Pressure |
|---|---|---|---|---|
| First Zone | 41 | 48° C | 65 psia | 5 psia |
| Second Zone | 45 | 42° C | 210–220 psia | |
| Third Zone | 46.5 | 11.2° C | 250 psia | |

TABLE II

Heat source temperature of 150° C; absorbent is LiBr solution containing 30 percent by weight water.

| | Absorbent Concentration (Weight Percent Of Water) | Temperature Rise (At) In Contact Zones | Pressures In Contact Zones | Condenser pressure |
|---|---|---|---|---|
| First Zone | 40 | 50° C | 60 psia | 5 psia |
| Second Zone | 44.8 | 44° C | 210 psia | |
| Third Zone | 46 | 16.5° C | 320 psia | |

TABLE III

Heat source temperature is 150° C; absorbent is a solution of a 50:50 composition of $CaBr_2$ and LiBr in 10 percent water.

| | Absorbent Concentration (Weight Percent Of Water) | Temperature Rise (At) In Contact Zones | Pressures In Contact Zones | Condenser pressure |
|---|---|---|---|---|
| First Zone | 22 | 74° C | 60–65 psia | 3 psia |
| Second Zone | 27.4 | 43° C | 224 psia | |
| Third Zone | 29.4 | 21° C | 340 psia | |

TABLE IV

Heat source temperature is 150° C; absorbent is LiBr solution containing 30 wt. percent water.

| | Absorbent Concentration (Weight Percent Of Water) | Temperature Rise (At) In Contact Zones | Pressures In Contact Zones | Condenser pressure |
|---|---|---|---|---|
| First Zone | 40 | 50° C | 60–65 psia | 3 psia |
| Second Zone | 44.8 | 44° C | 200–210 psia | |
| Third Zone | 46 | 16.5° C | 300 psia | |

I claim as my invention:

1. A process for transferring thermal energy comprising contacting steam and a water absorbent solution in a first contact zone under conditions to absorb water and dilute the solution, and raise the temperature of the solution, the solution being in indirect heat exchange with an aqueous stream and raising the temperature of the aqueous stream and converting the aqueous stream to steam and water, passing diluted solution from the first contact zone to a second contact zone;

passing said aqueous stream to a condensation and separation zone wherein the aqueous stream is separated into steam and liquid water, passing steam from the condensation and separation zone to a second contact zone wherein the steam is contacted with diluted solution from the first contact zone, under conditions to absorb water and dilute further the solution, and raise further the temperature of the solution, passing liquid water from the condensation and separation zone in indirect heat exchange with the further-diluted solution in said second contact zone, and converting the bulk of the liquid water into high temperature steam, passing further-diluted solution from the second contact zone to a third contact zone, and contacting further-diluted solution in the third contact zone with said high temperature steam under conditions to absorb water, and dilute the further-diluted solution, and form a high temperature, heavily diluted solution, and transferring heat from the high temperature, heavily-diluted solution to a medium to be heated.

2. The method of claim 1 wherein the steam employed in the first contact zone is produced from water in indirect heat exchange with a thermal energy source.

3. The method of claim 2 wherein the heavily-diluted absorbent solution is regenerated and returned to the first contact zone.

4. The method of claim 3 wherein the thermal energy source supplies heat for regeneration of the heavily-diluted absorbent.

5. The method of claim 4 wherein the medium to be heated is preheated by heat exchange with the thermal energy source.

6. The method of claim 5 wherein the thermal energy source is used to preheat the aqueous stream supplied to the first contact zone.

7. The method of claim 1 wherein the heavily-diluted absorbent solution is regenerated and returned to the first contact zone.

8. The method of claim 7 wherein steam supplies the heat for regeneration of the heavily-diluted absorbent.

9. The method of claim 8 wherein the medium to be heated is preheated by heat exchange with the steam.

10. The method of claim 9 wherein steam is used to preheat the aqueous stream supplied to the first contact zone.

11. The method of claim 1 wherein the water absorbent solution is selected from solutions of electrolytes and mixtures of electrolytes.

12. The method of claim 11 wherein the steam employed in the first contact zone is produced from water in indirect heat exchange with a thermal energy source.

13. The method of claim 12 wherein the heavily-diluted absorbent solution is regenerated and returned to the first contact zone.

14. The method of claim 13 wherein the thermal energy source supplies heat for regeneration of the heavily-diluted absorbent.

15. The method of claim 14 wherein the medium to be heated is preheated by heat exchange with the thermal energy source.

16. The method of claim 15 wherein the thermal energy source is used to preheat the aqueous stream supplied to the first contact zone.

17. The method of claim 11 wherein the heavily-diluted absorbent solution is regenerated and returned to the first contact zone.

18. The method of claim 17 wherein steam supplies the heat for regeneration of the heavily-diluted absorbent.

19. The method of claim 18 wherein the medium to be heated is preheated by heat exchange with the steam.

20. The method of claim 19 wherein steam is used to preheat the aqueous stream supplied to the first contact zone.

21. The method of claim 11 wherein the electrolyte solution contains lithium bromide, and the concentration of the lithium bromide in the initial contact zone is from 40 to 95 percent by weight, based on the total weight of solvent and lithium bromide.

22. The method of claim 11 wherein the electrolyte solution contains a mixture of lithium bromide and calcium bromide, and the concentration of the mixture in the initial contact zone is from 40 to 95 percent by weight, based on the total weight of solvent and mixture.

23. The method of claim 21 wherein the steam employed in the first contact zone is produced from water in indirect heat exchange with a thermal energy source.

24. The method of claim 23 wherein the heavily-diluted absorbent solution is regenerated and returned to the first contact zone.

25. The method of claim 24 wherein the thermal energy source supplies heat for regeneration of the heavily-diluted absorbent.

26. The method of claim 25 wherein the medium to be heated is preheated by heat exchange with the thermal energy source.

27. The method of claim 26 wherein the thermal energy source is used to preheat the aqueous stream supplied to the first contact zone.

28. The method of claim 22 wherein the steam employed in the first contact zone is produced from water in indirect heat exchange with a thermal energy source.

29. The method of claim 28 wherein the heavily-diluted absorbent solution is regenerated and returned to the first contact zone.

30. The method of claim 29 wherein steam supplies the heat for regeneration of the heavily-diluted absorbent.

31. The method of claim 30 wherein the medium to be heated is preheated by heat exchange with the steam.

32. The method of claim 31 wherein steam is used to preheat the aqueous stream supplied to the first contact zone.

* * * * *